United States Patent [19]

Matsunami

[11] Patent Number: 4,869,760

[45] Date of Patent: Sep. 26, 1989

[54] METHOD FOR PRODUCTION OF METALLIC STICKER

[75] Inventor: Hiromi Matsunami, Gifu, Japan

[73] Assignee: Kayoh Technical Industry Co., Ltd., Gifu, Japan

[21] Appl. No.: 8,599

[22] Filed: Jan. 28, 1987

[51] Int. Cl.[4] ..... C25D 1/00; B32B 31/00; C09J 7/02

[52] U.S. Cl. ..... 156/151; 156/249; 156/235; 430/324; 430/327; 204/4; 204/8; 428/201; 428/209; 428/344; 428/352; 428/354; 428/542.2; 428/542.8; 428/913.3; 428/914

[58] Field of Search ..... 430/320, 322, 324, 325, 430/326, 339, 328, 327; 156/150, 151, 152, 249, 235; 428/913.3, 914, 156, 172, 173, 200, 201, 202, 209, 343, 344, 352, 353, 457, 458, 542.2, 542.8, 354; 204/3, 4, 8, 12, 13, 18.1

[56] References Cited

U.S. PATENT DOCUMENTS

| | | | |
|---|---|---|---|
| 2,819,164 | 1/1958 | Boersma | 430/325 |
| 3,277,541 | 11/1966 | Wilton et al. | 430/320 |
| 3,503,815 | 3/1970 | Johnson | 430/320 |
| 3,676,248 | 7/1972 | Swartz | 428/913.3 |
| 3,782,939 | 11/1974 | Bonham et al. | 430/320 |
| 3,799,829 | 3/1974 | Heutwole | 156/249 |
| 4,104,070 | 8/1978 | Moritz et al. | 430/325 |
| 4,205,989 | 6/1980 | Moriya et al. | 430/319 |
| 4,247,619 | 1/1981 | Cohen et al. | 430/320 |
| 4,266,006 | 5/1981 | Uhlig et al. | 430/320 |
| 4,347,304 | 8/1982 | Sakurai et al. | 430/325 |
| 4,400,419 | 8/1983 | Laczynski | 156/249 |
| 4,444,869 | 4/1984 | Chonan et al. | 430/325 |
| 4,583,866 | 4/1986 | Kasai et al. | 430/320 |
| 4,584,039 | 4/1986 | Shea | 156/249 |
| 4,645,556 | 2/1987 | Waugh et al. | 156/249 |
| 4,668,607 | 5/1987 | Wojcik | 430/322 |

*Primary Examiner*—Thurman K. Page
*Assistant Examiner*—Donald J. Loney
*Attorney, Agent, or Firm*—Michael D. Rechtin; Philip P. Mann

[57] ABSTRACT

This invention discloses a method for the production of a sticker, which comprises a step for superposing an electrodeposited layer by electroforming on a patterning member exposing part of a metallic plate therethrough, a step for forming a decorative piece by applying an adhesive film to the electroformed surface of the patterning member and removing the adhesive film in combination with the electrodeposited layer from the patterning member, and a step for applying the decorative piece in combination with the adhesive film to a release sheet.

12 Claims, 2 Drawing Sheets

METHOD FOR PRODUCTION OF METALLIC STICKER

FIELD OF THE INVENTION:

This invention relates to a method for the production of thin metallic display sheets for fast adhesion such as, for example, stickers, seals, nomenclature plates, and nameplates (hereinafter referred to collectively as "sticker").

DESCRIPTION OF THE RELATED ART:

The production of stickers from a thin metallic sheet is generally accomplished by the steps of punching the thin metallic sheet into pieces of a desired outline, etching the removed pieces with an etchant such as a ferric chloride solution for thereby forming a desired pattern thereon, and subsequently giving the pieces a decorative finish by metal plating. After completion of the metal plating, each of the decorative pieces thus obtained is coated on the rear side thereof with an adhesive agent and applied separably on a release sheet. Then, the product is draped with a transparent film, which is separably applied to the release sheet.

By the procedure described above, the production of the sticker proves to be very complicated because each decorative piece must be prepared through the steps of punching, etching, and metal plating and this decorative piece must subsequently be applied to the release sheet and covered with the film. It is also difficult to apply the etchant to the removed metal piece exactly in conformity with the desired pattern. Particularly when the pattern has a delicate design, it is virtually impossible to obtain the pattern faithfully by the procedure.

Further when one pattern is not in a continuous design but in two or more separate designs intended to be formed severally on as many decorative pieces, since the decorative pieces are obtained asunder, there ensues a difficult task of arranging the separate decorative pieces so as to complete the pattern as desired.

SUMMARY OF THE INVENTION:

An object of this invention is to provide a method for the production of a sticker, which is simple in procedure, permits a pattern of delicate design to be formed faithfully, and enables a pattern of separate designs to be arranged in a desired condition.

To accomplish the object described above according to this invention, there is provided a method which comprises a step for superposing an electrodeposited layer by electroforming on a patterning member exposing part of a metallic sheet therethrough, a step for applying an adhesive film on the electroformed surface of said patterning member subsequently to completion of said electroforming step, separating said adhesive film in conjunction with said electrodeposited layer from said patterning member thereby preparing a decorative piece, and a step for applying said decorative piece in conjunction with said adhesive film to a release sheet subsequently to completion of said separation step.

The other objects of this invention will become apparent from comprehension of an embodiment of the invention to be described herein below and will be specifically defined in the appended claims. The numerous advantages of this invention not dealt with in the text hereof will be appreciated by persons skilled in the art by working the present invention.

DETAILED DESCRIPTION OF THE PREFERRED EMBODIMENT:

Now, one working example of this invention will be described in detail below with reference to the accompanying drawings.

Figure 1:
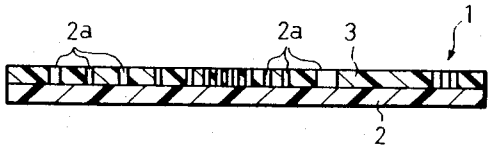
FIG. 1 is a cross section illustrating a patterning member.
Figure 2:
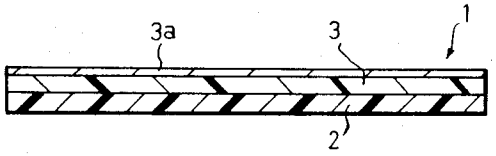
FIG. 2 is a cross section illustrating a method for the formation of the patterning member.
Figure 3:
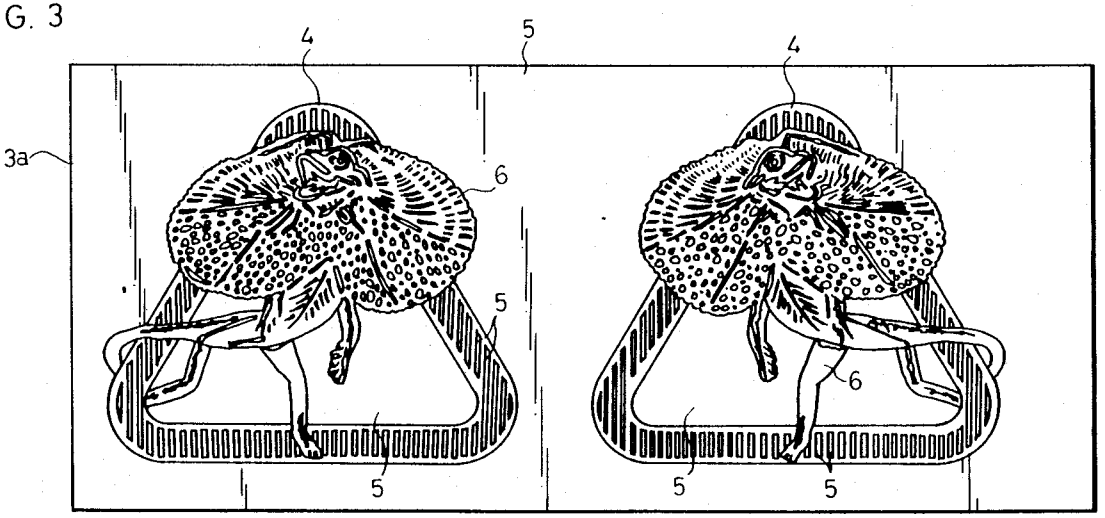
FIG. 3 is a plan view illustrating a positive to be used for the formation of the patterning member.

In the drawings, FIG. 1 illustrates a patterning member 1 in its entirety. The patterning member 1 comprises a metallic plate 2 made such as of copper or stainless steel and a resin layer 3 superposed fast on the metallic plate 2. The method for the production of the metallic plate 1 will be described in detail below. The resin layer 3 is formed by applying a liquid synthetic resin material (a product of Fuji Pharmaceutical Industry marketed under trademark designation of "Fuji Photoetching Resist," for example) possessing photosensitivity on the metallic plate 2 as illustrated in FIG. 2 and allowing the applied resin material to dry. Then, a positive 3*a* for monochromic photography is superposed on the resin layer 3. The positive 3*a* is a product obtained by photographing a desired pattern 4 as illustrated in FIG. 3, for example, and then developing the pattern.

After the positive 3*a* is superposed on the resin layer 3, it is exposed upwardly to the intense light of an arc lamp or a mercury vapor lamp disposed above the positive 3*a*. During this treatment of exposure, the light emitted from the arc lamp, for example, is allowed to pass through a transparent portion 5 (the portion having the emulsion fixed) of the positive 3*a* and reach the resin layer 3 and is intercepted in an opaque portion 6 (the portion having the emulsion washed away) and consequently prevented from reaching the resin layer 3. In the resin layer 3, therefore, there are formed a sensitized portion and an unsensitized portion in conformity with the transparent portion 5 and the opaque portion 6 of the positive 3*a*. Thereafter, the positive 3*a* is separate from the resin layer 3 and the resin layer 3 is treated with a solvent such as kerosene or trichloroethylene. By consequently dissolving and removing selectively the unsensitized portion of the resin layer 3, there is formed a depressed portion 2*a* through which the underlying metallic plate 2 is exposed. Thus, there is obtained the patterning member 1 which possesses depressed and raised surfaces corresponding to the shape of a pattern 4 of the positive 3*a*.

Figure 4:
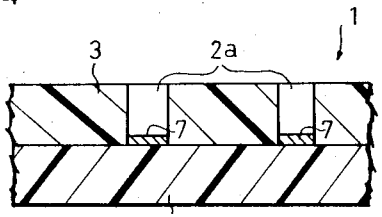
FIG. 4 is a magnified cross section illustrating the essential part of the patterning member in a state to be assumed after treatment with a chromic acid solution.

The patterning member 1 produced as described above is kept immersed for about 30 seconds in an aqueous 2% chromic acid solution and then washed with cold water. As the result, a thin coat 7 of chromium is deposited fast on the surface of the metallic plate exposed through the depressed portion 2*a* of the patterning member 1 as illustrated in FIG. 4. This step for the formation of the thin coat is carried out by the same method as generally adopted in the treatment of chromation for the purpose of smoothening the surface of the metallic plate. In the present embodiment, however, the formation of the thin coat is intended for facilitating separating of an electrodeposited layer 11 which is to be formed on the patterning member 1 by an electroforming treatment as described fully later.

Figure 5A:
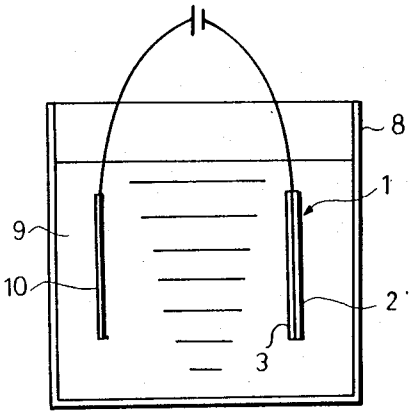
FIGS. 5 (a) and 5 (b) are respectively an explanatory diagram and a magnified cross section illustrating the condition of electroforming.
Figure 5B:
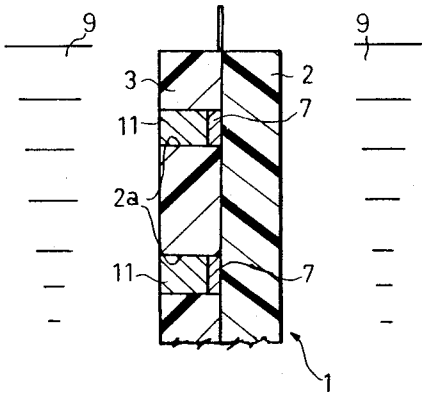

After the separating coat 7 is superposed on the depressed portion 2*a* of the patterning member 1, the patterning member is subjected to the step for electroforming in an electrolytic solution 9 held in an electrolytic bath 8 as illustrated in FIG. 5 (a). The aforementioned electrolytic solution 9 is formed by mixing 240 g/liter of copper sulfate, 90 g/liter of sulfuric acid, and a minute amount of a brightener (a product of Okuno Pharmaceutical Co., Ltd. marketed under trademark designation of "Catalacid CU", for example). An electric current is passed between an electroforming material 10 made of nickel and the patterning member 1 opposed to each other in the electrolytic solution 9, to superpose an electro deposited layer 11 on the depressed portion 2*a* of the patterning member 1 as illustrated in FIG. 5 (b). The magnitude of the electric current used in this case is fixed at 1 A per square decimeter of the exposed portion of the metallic plate 2 in the depressed portion 2*a* of the patterning member 1. The rear side of the metallic plate 2 exposed on the entire surface of the patterning member 1 which has not undergone the electroforming treatment is treated in advance with a lacquer and consequently caused to assume an ability to evade electrodeposition.

Figure 6:
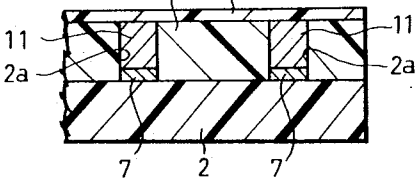
FIG. 6 and FIG. 7 are magnified cross sections illustrating a method for the formation of a decorative piece by the separation of the electrodeposited layer from the patterning member.
Figure 7:
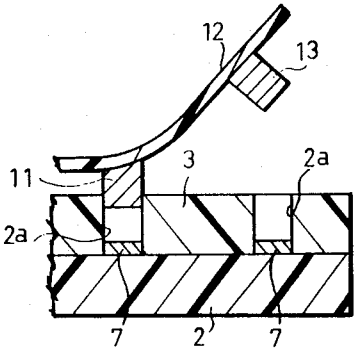

After the superposition of the electrodeposited layer 11 on the patterning member 1 is completed, the patterning member 1 is withdrawn from the electrolytic bath 8 and dried in a current of hot air. When the patterning member 1 is thoroughly dried, a transparent adhesive film 12 made of synthetic resin is provisionally tacked to the electroformed surface of the patterning member 1 as illustrated in FIG. 6. Then, the adhesive film 12 is separated in conjunction with the electrodeposited layer 11 from the patterning member 1 as illustrated in FIG. 7. In this case, the electrodeposited layer 11 within the depressed portion 2*a* of the patterning member 1 is easily separated from the metallic plate 2 exposed inside the depressed portion 2*a* owing to the action of the separating coat 7 and a decorative piece 13 of the shape corresponding to the pattern 4 of the positive 3*a* is obtained as applied fast to the adhesive film 12.

Figure 8:
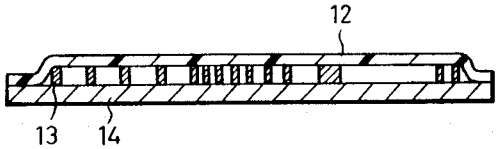
FIG. 8 is a cross section illustrating a sticker.

After the aforementioned adhesive film 12 is removed from the patterning member 1, the decorative piece 13 is provided on the rear side thereof with an adhesive agent and then the adhesive film 12 and the decorative piece 13 are both applied to the front side of a release sheet 14 as illustrated in FIG. 8. The release sheet 14 is treated on the front side thereof with wax or silicone so as to facilitate the subsequent separation of the adhesive film 12 therefrom. When the decorative piece 13 is desired to be used as stuck to a given object such as the body of an automobile, for example, it suffices to separate the adhesive film 12 together with the decorative piece 13 from the release sheet 14, apply them fast on the object, and separate the adhesive film 12 selectively from the object.

In the present working example, the pattern 4 is depicted as being formed of a pair of separate decorative pieces 13 which are disposed laterally to each other. Since these two decorative pieces 13 are formed by transferring the electrodeposited layer 11 within the depressed portion 2*a* of the patterning member 1 onto the adhesive film 12, they can be applied to the object without impairing the mutual positional relation between the two pieces 13.

Further, since the decorative piece 13 is finished in a desired shape by electroforming, it is faithfully formed even in a delicate design. The production of the decorative piece 13 is simple because it can be formed solely by the step of electroforming.

The present invention is not restricted to the working example cited above but may be otherwise practised as follows, for example.

(1) The color and the aesthetic grade of the decorative piece 13 may be varied by using gold, silver, or chromium in the place of nickel as the electroforming material 10.

(2) On the surface of the metallic plate 2, the separating coat 7 may be formed directly by the black chromium plating technique. Then, the depressed and raised surfaces are formed on the separating coat 7 in conformity to the shape of the pattern 4 by the screen printing technique using a non-conductive ink, to give rise to the patterning member 1 containing the aforementioned depressed portion 2*a*.

Since it is plain that this invention can be embodied as altered and modified in a wide range without departing from the spirit and scope of this invention, this invention is not restricted to any specific embodiment but may be practised otherwise within the scope defined by the claims appended hereto.

What is claimed is:

1. A method for production of a metallic sticker, comprising the steps of:

providing a patterning member including a metallic plate having first and second surfaces and a nonconductive layer formed on said first surface, said nonconductive layer having a depressed portion through which at least part of said first surface of said metallic plate is exposed with said depressed portion forming a desired pattern for said metallic sticker;

providing a separating coat on said part of said first surface of said metallic plate;

treating said second surface of said metallic plate to prevent electrodeposition on said second surface;

electroforming said patterning member to form an electrodeposited layer having upper and lower surfaces on said separating coat at said depressed portion;

applying an adhesive film over said first surface of said patterning member and said upper surface of said electrodeposited layer so as to adhere separably to said upper surface of said electrodeposited layer;

separating said adhesive film together with said electrodeposited layer from said patterning member, said electrodeposited layer being separated from said patterning member without sticking thereto as a consequence of said separating coat; and applying a release sheet to said electrodeposited layer on said lower surface opposite to said upper surface.

2. The method of claim 1 wherein said non-conductive layer is composed of a resin layer made of a photosensitive synthetic resin material with said patterning member obtained by the steps comprising, masking said resin layer with a positive for monochromic photography having said desired pattern thereon, exposing said resin layer through said positive to light, separating said positive from said resin layer, treating said resin layer with a solvent for forming said depressed portion, and said separating coat formed at said depressed portion by means of a chromium treatment.

3. The method as described in claim 1 wherein said treating step comprises applying a lacquer on said second surface to prevent said electrodeposition.

4. The method as defined in claim 1 wherein said step of providing a separating coat comprises applying a chromium on at least part of said first surface of said metallic plate.

5. A method for production of a metallic sticker, comprising the steps of:

providing a patterning member including a metallic plate having first and second surfaces and a nonconductive layer formed on said first surface of said metallic plate, said nonconductive layer having a depressed portion through which at least part of said first surface of said metallic plate is exposed so as to form a desired pattern;

providing a separating coat composed of a chromium on at least said part of said first surface of said metallic plate of said patterning member;

treating said second surface of said metallic plate with a lacquer so as to assume an ability to evade electrodeposition;

electroforming said patterning member thereby forming an electrodeposited layer having upper and lower surfaces on said separating coat at said depressed portion;

applying an adhesive film over said first surface of said patterning member electroformed with said electrodeposited layer so as to adhere separably to said upper surface of said electrodeposited layer;

separating said adhesive film together with said electrodeposited layer from said patterning member, said electrodeposited layer being separated from said patterning member without any sticking thereto owing to said separating coat; and applying a release sheet through an adhesive agent separably to said lower surface of said electrodeposited layer.

6. A method for production of a metallic sticker, comprising the steps of:

providing a metallic plate having first and second surfaces;

forming a separating layer on said first surface of said metallic plate;

generating a nonconductive layer on said separating layer, said nonconductive layer having a raised portion and a depressed portion exposing at least part of said separating layer with said raised and depressed portion being characteristic of the desired pattern of said metallic sticker;

treating said second surface of said metallic plate to prevent electrodeposition on said second surface;

electroforming said patterning member for forming an electrodeposited layer on said separating coat at said depressed portion, said electrodeposited layer having a lower surface in contact with said separating coat and an upper surface opposite said lower surface;

applying an adhesive film to said first surface of said patterning member and over said upper surface of said electrodeposited layer so as to adhere separably to said upper surface of said electrodeposited layer;

separating said adhesive film together with said electrodeposited layer from said patterning member, said electrodeposited layer being separated from said patterning member without sticking thereto as a consequence of said separating coat; and applying a separable release sheet to said electrodeposited layer on said lower surface opposite to said upper surface.

7. The method as defined in claim 6 wherein said step of generating a non-conductive layer comprises screen printing said raised portion.

8. A method for producing a metallic sticker comprising the steps of:

providing a patterning member having one side adapted to accept an electrodeposited layer and including a metallic plate having a first surface and further including a nonmetallic layer over said metallic plate, said patterning member having a depressed portion in said nonmetallic layer through which said first surface of said metallic plate is exposed;

generating an electrodeposited layer having first and second surfaces within said depressed portion of said patterning member;

applying an adhesive film to said side of said patterning member electroformed with said electrodeposited layer so as to adhere separably to said first surface of said electrodeposited layer;

separating said adhesive film together with said electrodeposited layer from said patterning member;

applying a release sheet to said second surface of said electrodeposited layer; and providing, prior to said step of generating said electrodeposited layer, a separating coat on at least said exposed first surface of said metallic plate of said patterning member.

9. The method as defined in claim 8 further including the step of treating said metallic plate to prevent electrodeposition on said metallic plate opposite said nonmetallic layer.

10. The intermediate product of claim 8 comprising said patterning member, said separating coat, said electrodeposited layer and said adhesive film.

11. The intermediate product of claim 1 comprising said patterning member, said separating coat, said electrodeposited layer and said adhesive film.

12. The intermediate product of claim 5 comprising said patterning member, said separating coat, said electrodeposited layer and said adhesive film.

* * * * *